US009045937B2

(12) United States Patent
Peck et al.

(10) Patent No.: US 9,045,937 B2
(45) Date of Patent: Jun. 2, 2015

(54) GARAGE DOOR STOP AND SEAL SYSTEM

(71) Applicant: MarPec, Inc., Cedar Rapids, IA (US)

(72) Inventors: Robert William Peck, Cedar Rapids, IA (US); Mark William Loughren, Mt. Vernon, IA (US)

(73) Assignee: Marpee, Inc., Cedar Rapids, IA (US)

( * ) Notice: Subject to any disclaimer, the term of this patent is extended or adjusted under 35 U.S.C. 154(b) by 0 days.

(21) Appl. No.: 14/215,458

(22) Filed: Mar. 17, 2014

(65) Prior Publication Data

US 2014/0259954 A1 Sep. 18, 2014

Related U.S. Application Data

(60) Provisional application No. 61/786,352, filed on Mar. 15, 2013.

(51) Int. Cl.

| | |
|---|---|
| ***E06B 9/58*** | (2006.01) |
| ***E06B 7/16*** | (2006.01) |
| ***E06B 7/23*** | (2006.01) |

(52) U.S. Cl.

CPC . *E06B 9/582* (2013.01); *E06B 7/16* (2013.01); *E06B 7/2316* (2013.01); *E06B 7/231* (2013.01)

(58) Field of Classification Search

CPC ..... E06B 9/582

USPC ..... 49/197, 199, 475.1, 489.1, 492.1, 49/496.1; 160/40, 201

See application file for complete search history.

(56) References Cited

U.S. PATENT DOCUMENTS

| | | | | |
|---|---|---|---|---|
| 1,947,350 | A * | 2/1934 | Macklanburg | 49/475.1 |
| 2,734,238 | A * | 2/1956 | Clapp | 49/493.1 |
| 3,339,619 | A * | 9/1967 | Crosswell | 160/40 |
| 3,358,402 | A * | 12/1967 | Sahm | 49/401 |
| 4,930,257 | A * | 6/1990 | Windgassen | 49/504 |
| 5,230,180 | A * | 7/1993 | Tweedt et al. | 49/400 |
| 5,335,450 | A * | 8/1994 | Procton | 49/368 |
| 5,435,104 | A * | 7/1995 | Dietrich | 49/493.1 |
| 5,784,834 | A * | 7/1998 | Stutzman | 49/475.1 |
| 6,374,567 | B1 * | 4/2002 | Mullet | 52/716.1 |
| 6,772,560 | B2 * | 8/2004 | Dischiant et al. | 49/496.1 |
| 6,772,561 | B1 * | 8/2004 | Berger, Jr. | 49/496.1 |

* cited by examiner

*Primary Examiner* — Katherine Mitchell
*Assistant Examiner* — Marcus Menezes
(74) *Attorney, Agent, or Firm* — Richards Patent Law P.C.

(57) ABSTRACT

The present disclosure provides a garage door stop and seal system that allows for expansion and contraction, enables replacement of the seal, and provides hidden, or concealed, fasteners. The system includes a door stop that removeably snaps into a receiver, wherein the door stop conceals the fasteners used to connect the receiver to a door jamb. In addition, the door stop includes a receiving space for a replaceable seal.

9 Claims, 2 Drawing Sheets

GARAGE DOOR STOP AND SEAL SYSTEM

CROSS-REFERENCE TO RELATED APPLICATIONS

This application incorporates by reference and claims priority to U.S. Provisional Application 61/786,352 filed on Mar. 15, 2013.

BACKGROUND OF THE INVENTION

The present subject matter relates generally to a garage door stop and seal system. Specifically, the present invention relates to a garage door stop and seal system including a door stop that conceals fasteners used to attach the system to a door jamb.

Seals that are currently on the market do not have concealed fasteners, removable or replaceable seals, and do not allow for expansion and contraction of the door stop. Exposed fasteners detract from the appearance of the home and allow the elements to directly effect the fasteners causing them to rust or discolor. The seals wear out eventually requiring the entire door stop and seal to be replaced. Not allowing for expansion and contraction causes the seals to buckle and warp when the materials expand and contract due to fluctuations in temperature.

Accordingly, there is a need for a garage door stop and seal system that allows for expansion and contraction of the door stop and seal. In addition, there is a need for a door stop that conceals fasteners, and enables the replacement of door seals.

BRIEF SUMMARY OF THE INVENTION

To meet the needs described above and others, the present disclosure provides a garage door stop system that allows for expansion and contraction of the door stop, enables replacement of the seal, and provides hidden, or concealed, fasteners.

The present disclosure provides a snap lock garage door stop and seal system that includes a replaceable seal, which is removable within a door stop. The door stop attaches to a receiver, wherein the door stop conceals fasteners that are used to secure the system to the door jamb. The door stop and the receiver may be extruded from any number of materials including, but not limited to, aluminum, polyvinyl chloride, and polypropylene, among others. In addition, the door stop may include a slot to receive the seal. The receiver and the door stop are designed to allow each to expand and contract independently of each other during, for example, during installation as well as over time due to climate changes.

In an embodiment, the garage door stop and seal system includes a receiver that mates with a door stop. The receiver includes a receiver body including a receiver inner surface, a receiver outer surface, a receiver first end, and a receiver second end. The receiver further includes a first receiver tab extending from the receiver first end, and a second receiver tab extending from the second end.

The door stop includes a stop body having an stop inner surface, a stop outer surface, a stop first end, and a stop second end. The stop first end includes a slot forming a receiving space, wherein a cross-sectional length of the receiving space is parallel to a cross-sectional length of the stop body.

The stop first end includes a first seat configured to removeably receive the first receiver tab, wherein the stop second end includes a second seat configured to removeably receive the second receiver tab.

The door stop further includes at least one spacer extending perpendicular from the stop inner surface of the stop body.

For example, when the first receiver tab is engaged with the first seat and the second receiver tab is engaged with the second seat, the spacer creates a space between the stop inner surface and the receiver outer surface.

In an example, the first receiver tab removeably snaps into the first seat and the second receiver tab removeably snaps into the second seat. In another example, the first receiver tab and the second receiver tab are different shapes.

In yet another example, the second stop end includes an incline adjacent to the second seat, wherein the second seat is an angular notch to receive the second receiver tab.

The system may further include a seal, wherein a portion of the seal is removeably positioned in the receiving space of the slot. In an example, the slot may be an alligator retainer slot.

The receiver may include a receiver opening through the receiver body to receive a fastener. In an example, the system may further include a fastener, wherein at least a portion of the fastener is positioned in the receiver opening, wherein the fastener secures the receiver to a door jamb. When the first receiver tab is engaged with the first seat and the second receiver tab is engaged with the second seat, at least a portion of the fastener may be positioned within a portion of the space between the receiver outer surface and the stop inner surface.

In another embodiment, the system may include a door stop and a removable seal, wherein the door stop may not hide the fasteners. In such example, the removable seal may be replaced when needed and is free to expand and contract independently of the snap lock stop.

For example, the system may include a garage door stop including a stop body having an stop inner surface and stop outer surface, wherein a stop first end of the stop body includes a slot forming a receiving space, wherein a cross-sectional length of the receiving space is parallel to a cross-sectional length of the stop body. The door stop includes a stop opening through the stop body to receive a fastener. In an example, the door stop includes at least one spacer extending perpendicular from the stop inner surface of the stop body. For example, when the garage door stop is fastened to a door jamb, the spacer creates a space between the stop inner surface and the door jamb.

In an example, the receiving space is positioned between the stop inner surface and the stop outer surface of the stop body. The door stop may further include a seal that is removeably positioned in the receiving space of the slot. The door stop may further include a fastener, wherein at least a portion of the fastener is positioned in the stop opening, wherein the fastener secures the stop body to a door jamb.

An advantage of the present system is that it is easy to install and aesthetically pleasing. Specifically, the system conceals the seal behind the door stop, which results in the seal being less visible when the garage door is closed.

A further advantage of the present system is providing a snap lock receiver and snap lock door stop that may independently expand and contract, which improves the resiliency of the system during various weather conditions.

Another advantage of the present system is a configuration that conceals the fasteners used during installation, which allows for an improved seal between the system and the garage door.

Yet another advantage of the present system is providing a replaceable seal that may be replaced when the seal is worn without having to replace the entire door stop. Conventional systems typically have a seal integrated into the door stop itself. As a result, in conventional systems the entire door stop must be replaced when the seal has been worn out due to contact with the garage door.

Another advantage of the system disclosed herein includes providing an improved appearance of door stops by concealing fasteners, therefore, preventing the fasteners from rusting and discoloration.

Additional objects, advantages and novel features of the examples will be set forth in part in the description which follows, and in part will become apparent to those skilled in the art upon examination of the following description and the accompanying drawings or may be learned by production or operation of the examples. The objects and advantages of the concepts may be realized and attained by means of the methodologies, instrumentalities and combinations particularly pointed out in the appended claims.

BRIEF DESCRIPTION OF THE DRAWINGS

The drawing figures depict one or more implementations in accord with the present concepts, by way of example only, not by way of limitations. In the figures, like reference numerals refer to the same or similar elements.

DETAILED DESCRIPTION OF THE INVENTION

Figure 1:
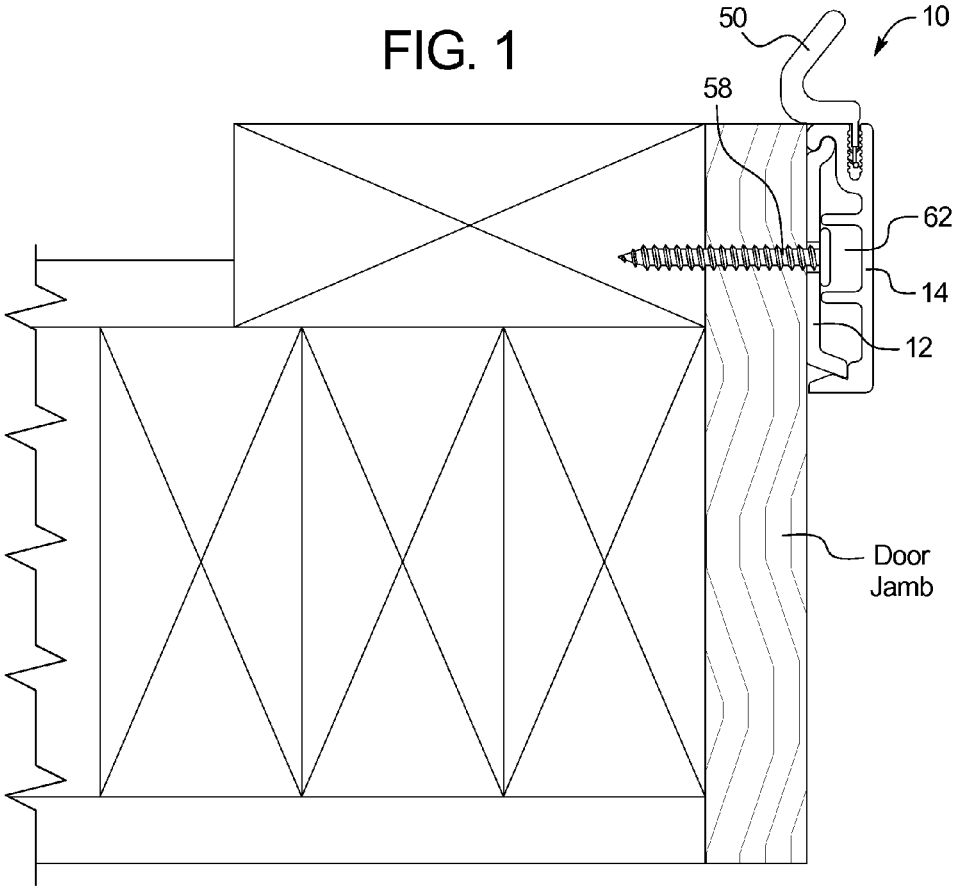
FIG. 1 is a cross-sectional view of the installed snap lock garage door stop and seal system.

As shown in FIG. 1, in an embodiment, the garage door stop and seal system 10 disclosed herein includes a receiver 12 that mates with a door stop 14, wherein the receiver 12 is configured to attach to a door jamb.

Figure 2:
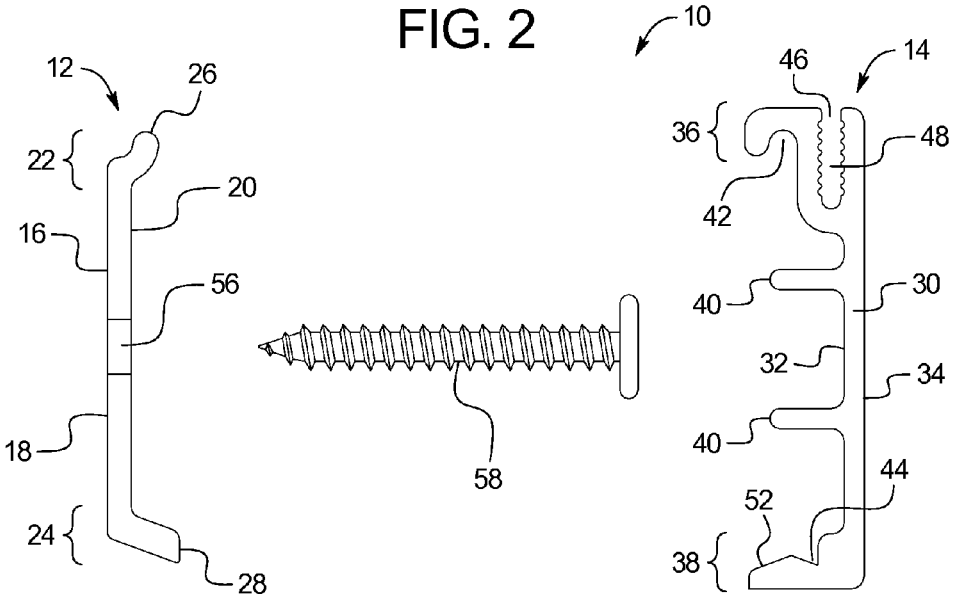
FIG. 2 is a cross-sectional side views of the individual parts of the snap lock garage door stop and seal system shown in FIG. 1.
Figure 3:
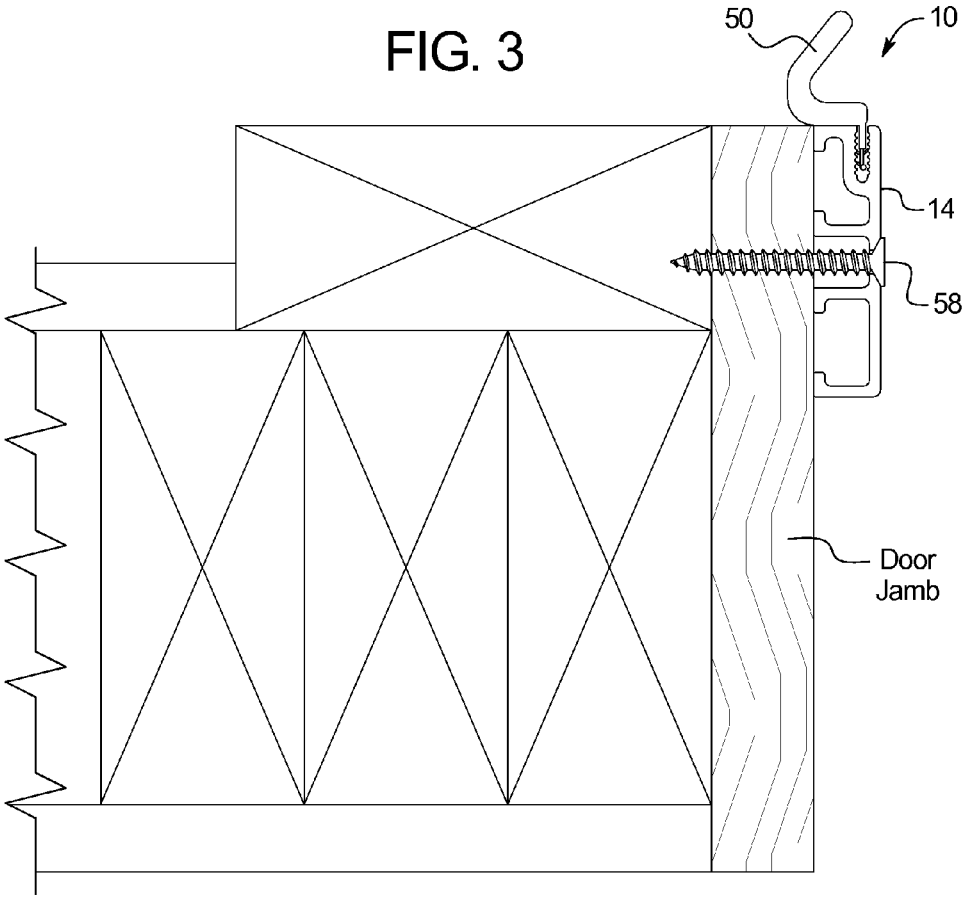
FIG. 3 is a cross-sectional view of an installed alternative version of the snap lock garage door stop and seal system.
Figure 4:
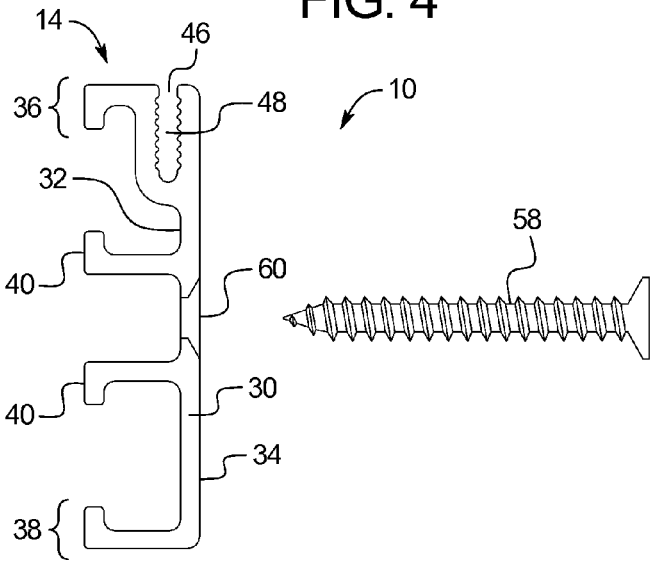
FIG. 4 is a cross-sectional side views of the individual parts of the alternative version of the snap lock garage door stop and seal system shown in FIG. 3.

FIG. 2 is an exploded view of an embodiment of the system 10. As shown, the receiver 12 includes a receiver body 16 including a receiver inner surface 18, a receiver outer surface 20, a receiver first end 22, and a receiver second end 24. The receiver body 16 may be a generally linear structure that fits flush against a door jamb.

The receiver 12 further includes a first receiver tab 26 extending from the receiver first end 22, and a second receiver tab 28 extending from the second end 24. The first receiver tab 26 and the second receiver tab 28 may be different shapes. As shown, the first receiver tab 26 may have a shape of an annular knob. The second receiver tab 28 may be in the shape of an angular point. Of course, various shapes may be used for the first receiver tab 26 and the second receiver tab 28.

The door stop 14 includes a stop body 30 having an stop inner surface 32, a stop outer surface 34, a stop first end 36, and a stop second end 38. The door stop 14 may further include at least one spacer 40 extending perpendicular from the stop inner surface 32 of the stop body 30. The stop first end 36 and stop second end 38 may also include spacers 40 extending from the stop inner surface 32. The spacers 40 are configured to enhance the structural integrity of the system 10. However, even in examples lacking the spacers 40, the structural integrity of the system is maintained. In addition, when the receiver 12 and the door stop 14 are connected, the spacers 40 maintain a space 62 or void between the receiver outer surface 20 and the stop inner surface 32. The space 62 created may partially house an end of a fastener 58, such that the fastener 58 is concealed from the environment and visually from an outside observer. It should be understood that the space 62 exists in examples that do not include the spacers 40.

The stop first end 36 includes a slot 46 forming a receiving space 48, wherein a cross-sectional length of the receiving space 48 is parallel to a cross-sectional length of the stop body 30. In an example, the receiving space 48 is positioned between the stop inner surface 32 and the stop outer surface 34 of the stop body 30. The receiving space 48 is configured to accept at least a portion of a seal 50. For example, a portion of the seal 50 may be removeably positioned in the receiving space 48 of the slot 46. In an example, the slot 46 may be an alligator retainer slot.

The stop first end 36 includes a first seat 42 configured to removeably receive the first receiver tab 26. The first seat 42 may be any shape that is suitable to receive the first receiver tab 26. For example, the first seat 42 is configured to receive the first receiver tab 26 that may have an annular or round knob shape.

Similarly, the stop second end 38 includes a second seat 44 configured to removeably receive the second receiver tab 28. The first seat 42 and the second seat 44 may be different shapes. For example, the second seat 44 may be angular notch 54 to receive the second receiver tab 28 that may have an angular point shape. The stop second end 38 may also an incline 52 adjacent to the second seat 44. The incline 52 may aid a user in engaging the second receiver tab 28 with the second seat 44 once the first receiver tab 26 has been engaged with the first seat 42. For example, if a user first engages the first receiver tab 26 with the first seat 42, a user may guide the second receiver tab 28 over the incline 52, after which the second receiver tab 28 may slip into the angular notch 54 to secure the receiver 12 to the door stop 14.

The first receiver tab 26 temporarily locks into the first seat 42 and the second receiver tab 28 temporarily locks into the second seat 44. In an example, the first receiver tab 26 removeably snaps into the first seat 42 and the second receiver tab 28 removeably snaps into the second seat 44.

The receiver 12 may include a receiver opening 56 through the receiver body 16 to receive a fastener 58. The fastener 58 may be any suitable fastener 58 that secures the receiver 12 to a door jamb. For example, the fastener 58 may be a screw, nail, adhesive, or combinations thereof, among others. At least a portion of a fastener 58 may be positioned in the receiver opening 56, wherein the fastener 58 secures the receiver 12 to a door jamb. As mentioned above, when the first receiver tab 26 is engaged with the first seat 42 and the second receiver tab 28 is engaged with the second seat 44, the spacer 40 creates a space 62 between the stop inner surface 32 and the receiver outer surface 20. At least a portion of the fastener 58 may positioned within a portion of the space 62 between the receiver outer surface 20 and the stop inner surface 32. For example, when the fastener 58 is a screw, the head of the screw may be positioned within space 62. As a result the fastener 58 is concealed from the environment and from view.

In another embodiment, the system 10 may include a door stop 14 and a removable seal 50, wherein the door stop 14 may not hide the fasteners 58. In such example, the removable seal 50 may be replaced when needed and is free to expand and contract independently of the door stop 14.

For example, the system 10 may include a door stop 14 including a stop body 30 having an stop inner surface 32 and stop outer surface 34, wherein a stop first end 36 of the stop body 30 includes a slot 46 forming a receiving space 48. A cross-sectional length of the receiving space 48 is parallel to a cross-sectional length of the stop body 30.

The door stop 14 may also include at least one spacer 40 extending perpendicular from the stop inner surface 32 of the stop body 30. When the garage door stop 14 is fastened to a door jamb, the spacer 40 creates a space 62 between the stop inner surface 32 and the door jamb.

The door stop includes a stop opening 60 through the stop body 30 to receive a fastener 58. The door stop 14 may further include a fastener 58, wherein at least a portion of the fastener 58 is positioned in the stop opening 60, wherein the fastener 58 secures the stop body 30 to a door jamb. The fastener 58 may be any suitable fastener 58 that secures the door stop 12 to a door jamb. For example, the fastener 58 may be a screw, nail, adhesive, or combinations thereof, among others.

In an example, the receiving space 48 is positioned between the stop inner surface 32 and the stop outer surface 34 of the stop body 30. The door stop 14 may further include a seal 50 that is removeably positioned in the receiving space 48 of the slot 46. The removable or replaceable seal 50 creates a seal against a garage door. In an example, the seal 50 may include a vinyl covered foam that allows for fluctuations in the distance between the door stop 14 and the garage door while maintaining an appropriate seal.

Figure 5:
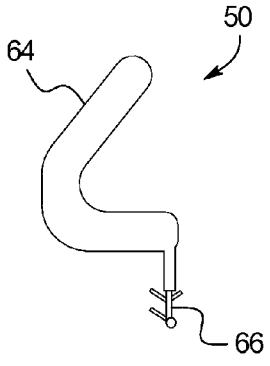
FIG. 5 is a cross-sectional view of an example of a seal disclosed herein.

As shown in FIG. 5, the seal 50 may include a folded portion 64 and an installation tab 66, wherein the installation tab 66 is configured to fit into the receiving space 48. The seal 50 may be secured in the receiving space 48 by a pressure fit, screw mechanism, or any other suitable removeable connection that allows the seal 50 to be replaced independent of the door stop 14. As a result, the seal 50 is free to expand and contract independently of the door stop 14.

It should be noted that various changes and modifications to the embodiments described herein will be apparent to those skilled in the art. Such changes and modifications may be made without departing from the spirit and scope of the present invention and without diminishing its attendant advantages. For example, various embodiments of the method and portable electronic device may be provided based on various combinations of the features and functions from the subject matter provided herein.

We claim:

1. A garage door stop and seal system comprising:

a receiver including a receiver body including a receiver inner surface, a receiver outer surface, a receiver first end, and a receiver second end, a first receiver tab extending from the receiver first end, and a second receiver tab extending from the second end;

a door stop including a stop body having an stop inner surface, a stop outer surface, a stop first end, and a stop second end; and at least one spacer extending perpendicular from the stop inner surface of the stop body, wherein the stop first end includes a first seat configured to removeably receive the first receiver tab, wherein the stop second end includes a second seat configured to removeably receive the second receiver tab, wherein the stop first end includes a slot forming a receiving space, wherein a cross-sectional length of the receiving space is parallel to a cross-sectional length of the stop body, wherein, when the first receiver tab is engaged with the first seat and the second receiver tab is engaged with the second seat, the at least one spacer directly contacts the receiver outer surface and creates a space between the stop inner surface and the receiver outer surface.

2. The system of claim 1 wherein the first receiver tab removeably engages with the first seat and the second receiver tab removeably engages with into the second seat.

3. The system of claim 1 wherein the first receiver tab and the second receiver tab are different shapes.

4. The system of claim 1 wherein the second stop end includes an incline adjacent to the second seat, wherein the second seat is an angular notch.

5. The system of claim 1 wherein the slot is an alligator a retainer slot.

6. The system of claim 1 further comprising a seal, wherein a portion of the seal is removeably positioned in the receiving space of the slot.

7. The system of claim 1 wherein the receiver further includes a receiver opening through the receiver body to receive a fastener.

8. The system of claim 7 further comprising a fastener, wherein at least a portion of the fastener is positioned in the receiver opening.

9. The system of claim 1 further comprising a fastener, wherein the fastener secures the receiver to a door jamb, wherein, when the first receiver tab is engaged with the first seat and the second receiver tab is engaged with the second seat, at least a portion of the fastener is positioned within a portion of the space between the receiver outer surface and the stop inner surface.

* * * * *